United States Patent [19]

Walter et al.

[11] Patent Number: 4,591,049

[45] Date of Patent: May 27, 1986

[54] HERMETICALLY SEALED TWO-COMPONENT MIXING SYSTEM

[75] Inventors: Carl W. Walter, Holliston; John L. Woodworth, Hopkinton, both of Mass.

[73] Assignee: Kidde, Inc., Saddle Brook, N.J.

[21] Appl. No.: 570,804

[22] Filed: Jan. 16, 1984

[51] Int. Cl.[4] ..... B65D 25/08

[52] U.S. Cl. ..... 206/222; 215/DIG. 8; 604/414; 604/415; 604/416

[58] Field of Search ..... 206/219–222; 215/6, DIG. 8; 222/83; 604/411–414, 415, 416

[56] References Cited

U.S. PATENT DOCUMENTS

| | | | |
|---|---|---|---|
| 3,337,039 | 8/1967 | Knittel et al. | 206/221 |
| 3,404,811 | 10/1968 | Cernei | 206/222 |
| 3,872,867 | 3/1975 | Killinger | 604/413 |
| 3,917,063 | 11/1975 | Chibret et al. | 215/DIG. 8 |
| 4,146,153 | 3/1979 | Bailen | 222/83 |
| 4,244,467 | 1/1981 | Cavazza | 206/222 |
| 4,346,820 | 8/1982 | Cavazza | 206/222 |
| 4,411,662 | 10/1983 | Pearson | 604/411 |

FOREIGN PATENT DOCUMENTS

| | | | |
|---|---|---|---|
| 2834095 | 4/1979 | Fed. Rep. of Germany | 222/83 |
| 2944639 | 5/1981 | Fed. Rep. of Germany | 604/411 |
| 2256752 | 8/1975 | France | 604/411 |

*Primary Examiner*—William Price

*Assistant Examiner*—Jimmy G. Foster

*Attorney, Agent, or Firm*—John E. Toupal; Harold G. Jarcho

[57] ABSTRACT

A mixing and dispensing receptacle including a first container defining a first nozzle portion and a first sealed chamber retaining a first substance and a rupturable wall portion separating the first chamber from the interior of the first nozzle portion; and a second container defining a second chamber retaining a second substance and a second nozzle portion disposed at least partially within the interior of the first nozzle portion and circumferentially sealed thereto so as to sealingly isolate the second substance. The second nozzle portion is movable axially relative to the first nozzle portion so as to pierce the rupturable wall portion and provide communication between the first and second chambers. One of the nozzle portions comprises a tapered outer surface adapted for engagement with a mating coupling member and an aseptic shield covers the tapered outer surface and is removable therefrom. After penetration of the rupturable wall portion by the second nozzle portion, the first and second substances are transferred between the first and second chambers to provide mixing thereof. The tapered outer surfaces is then engaged with a mating coupling member and the mixed substances discharged thereinto. Prior to its removal, the aseptic shield protects the tapered nozzle surface from any form of contamination.

18 Claims, 3 Drawing Figures

HERMETICALLY SEALED TWO-COMPONENT MIXING SYSTEM

BACKGROUND OF THE INVENTION

The present invention relates generally to a receptacle for mixing and dispensing two substances, and, more particularly, to such a device for dispensing dosed amounts of pharmaceutical formulations under sterile conditions.

It is well known that problems are often encountered when a liquid (e.g. a solvent) kept in a first sealed container is to be transferred under aseptic conditions into a second sealed container and mixed therein with a second substance in either solid or liquid form. This situation occurs particularly in the pharmaceutical art wherein solutions suitable for intravenous or oral administration are often extemporaneously prepared directly by the user by mixing a liquid solvent with a liquid or solid pharmacologically active agent. Both the solvent and the active agent typically are stored separately in distinct containers up to the moment of mixture prepartion.

Several devices have been disclosed, which are provided with pumping means for carrying out the transfer of a liquid solvent from a first sealed container into a second sealed container under aseptic conditions. Such devices are costly and cumbersome and frequently do not afford satisfactory results.

It has been also proposed to keep one of the containers under partial vacuum. When containers of that type are connected to each other by means of a double-tipped, hollow cannula inserted through the rubber plugs of both containers placed in superimposed relationship, the passage of the liquid solvent occurs from the container at atmospheric pressure into the container under partial vacuum. These arrangements also have proved to be costly and, cumbersome and liable to bacterial contamination.

In efforts to overcome the foregoing drawbacks, there was developed recently a system described in U.S. Pat. No. 4,244,467. Therein disclosed is an apparatus for mixing and dispensing two substances and including a first container, a second container, a plug seated in the neck of the second container and having a recess which is open in the upward and outward direction, and an elongated transfer spout secured in the base of the recess and projecting both inwardly into and outwardly from the second container. The spout is provided with two substantially parallel passages extending therethrough and the passage openings are located at different heights by the provision of bevelled end surfaces on the transfer spout.

A further improvement is described by U.S. Pat. No. 4,346,820. Disclosed in that patent is a combination with a first container containing a first substance in a sealed manner, the first container having a neck defining a discharge opening and being sealable by a stopper. A second container contains a second substance in a sealed manner, the second container having a neck defining a discharge opening. Dimensioned to receive the neck of the first container in a sealed manner is one end of a sleeve, the opposite end thereof receiving the neck of the second container. Intermediate the opposite end is a transversely extending, peripherally continuous septum provided with a centrally positioned opening. Although offering some advantages, the above described devices exhibit significant drawbacks such as being not directly compatible with conventional medical equipment used for intravenous administration.

SUMMARY OF THE INVENTION

The invention is a mixing and dispensing receptacle including a first container defining a first nozzle portion, a first sealed chamber retaining a first substance and a rupturable wall portion separating the first chamber from the interior of the first nozzle portion; and a second container defining a second chamber retaining a second substance and a second nozzle portion disposed at least partially within the interior of the first nozzle portion and circumferentially sealed thereto so as to sealingly isolate the second substance. The second nozzle portion is movable axially relative to the first nozzle portion so as to pierce the rupturable wall portion and provide communication between the first and second chambers. One of the nozzle portions comprises a tapered outer surface adapted for engagement with a mating coupling member and an aseptic shield covers the tapered outer surface and is removable therefrom. After penetration of the rupturable wall portion by the second nozzle portion, the first and second substances are transferred between the first and second chambers to provide mixing thereof. The tapered outer surface is then engaged with a mating coupling member and the mixed substances discharged thereinto. Prior to its removal, the aseptic shield protects the tapered nozzle surface from any form of contamination.

According to one feature of the invention, the tapered outer surface comprises a male Luer slip connection. Provision of a Luer slip coupling renders the device compatible for use in dispensing pharmaceutical preparations in a wide variety of medical applications involving intravenous administration.

According to another feature of the invention, the interior of the first nozzle portion defines inner threads and the outer surface of the second nozzle portion defines outer threads engaging the inner threads and movable therein to provide the relative axial movement. The engaged threads facilitate control of axial movement of the second nozzle portion through the rupturable wall portion in the first container to thereby permit mixing of the first and second substances.

According to yet another feature of the invention, the first nozzle portion comprises the Luer slip connection and the second container is adapted for disengagement from the first nozzle portion so as to permit coupling of the Luer slip with a mating female connection. In a preferred embodiment, the second nozzle portion comprises a weakened annulus adapted for rupture to permit the separation of the second container from the second nozzle portion.

According to still another feature of the invention, the device includes a stop for establishing an initial relative axial position between first and second nozzle portions. Preferably the stop comprises an annular ridge formed on the second nozzle portion and engaging the inner threads on the first nozzle portion. The stop prevents premature penetration of the rupturable wall but can be forcibly overcome to provide such penetration at a time of intended use. Preferably the annular ridge stop has a large diameter than the diameter of the opening into the interior of the first nozzle portion so as to form a tight circumferential seal therewith after being forcibly inserted thereinto.

According to still another feature of the invention, the asceptic shield comprises a plastic tube that is heat shrunk over the first and second nozzle portions. The heat shrunk shield maintains the Luer slip connection under aseptic conditions and is removed just prior to use of the dispensing device.

The invention further includes methods for producing a mixing and dispensing receptacle of the above featured types.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
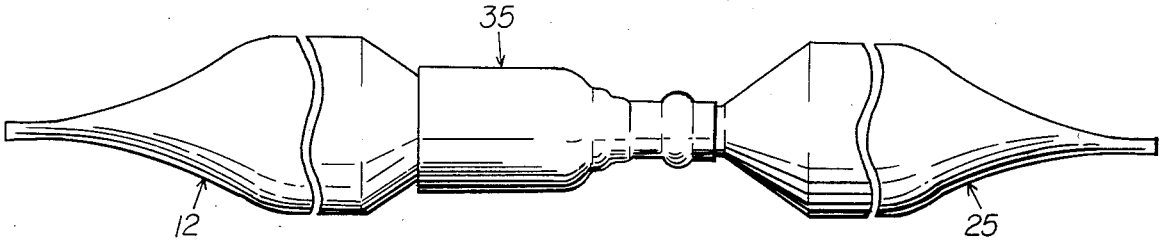
FIG. 1 is a schematic elevational view of a dispenser according to the invention.

The mixing and dispensing device 11 includes a first flexible tube container 12 that defines a first chamber 13. Also defined by the container 12 is a first hollow nozzle portion 14 having a hollow interior 15 that is hermetically sealed from the first chamber 13 by a rupturable wall portion 16. The outer surface 17 of the first nozzle portion 14 is tapered inwardly towards its mouth 18 in the form of the well known male Luer slip connection having an 0.060 inch taper per inch. A complete description of Luer connections appears in American Standard Dimensions of Glass and Metal Luer Tapers for Medical Applications published in 1955 by American Standards Association, Incorporated. Terminating the first nozzle portion 14 is an inwardly projecting rim 19 that defines the mouth 18 and provides therefor an opening of reduced diameter. The inner surface of the first nozzle portion defines a set of inner threads 21 and the first chamber 13 is substantially filled by a first substance 22.

Another component of the device 11 is a second flexible tube container 25 that defines a second chamber 26 filled with a second substance 27 to be mixed with the first substance 22 prior to use thereof. Extending from the second container 25 is a second hollow nozzle portion 28 that projects into the interior 15 of the first nozzle portion 14. The outer surface of the second nozzle portion 28 defines outer threads 31 that engage the inner threads 21 on the first nozzle portion 14. Also formed on the outer surface of the second nozzle portion 28 is an annular spherically shaped ridge stop 32 positioned between the outer threads 31 and the mouth 18 of the first nozzle portion 14. The diameter of the annular ridge stop 32 is greater than that of the mouth 18 formed by the inwardly projecting rim 19 on the first nozzle portion 14. Disposed between the rim 18 and the main body of the second container 25 is a weakened annulus portion 33 of the second nozzle portion 28.

Covering both the first nozzle portion 14 and the second nozzle portion 28 is a plastic tube 35 that provides an aseptic shield for the first and second nozzle portions 14 and 38. Preferably, the tube 35 is heat shrunk into intimate contact with both the Luer slip surface 17 of the first nozzle portion 14 and the outer surface of the second nozzle portion 28. To provide a more secure attachment between the heat shrunk tube 35 and the second nozzle portion 28, annular ridges 36 are provided thereon in the form of additional external threads.

Figure 2:
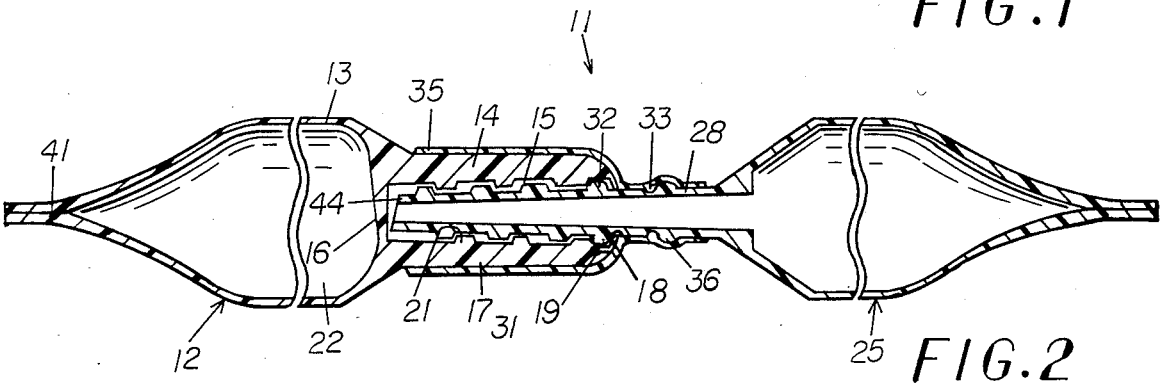
FIG. 2 is a schematic axial cross-sectional view of the dispenser shown in FIG. 1.

During production of the dispensing and mixing device 11, the first flexible tube container 12 is filled under partial vacuum with the substance 22 through an open end 41 which is then hermetically sealed. Then, after the plastic tube 35 has been positioned over the first nozzle portion 14, the second nozzle portion 28 is screwed into the first nozzle portion 14 until the relative positions shown in FIG. 2 are reached. During this entry of the second nozzle portion 28 into the first nozzle portion 14, the inner threads 21 threadedly engage the outer threads 31. After being forced through the reduced diameter mouth 18, the ridge stop 32 engages the inner threads 21 to restrict further inward movement of the second nozzle portion 28 with its end 44 directly adjacent to the rupturable wall portion 16 of the first container tube 12. Further relative axial movement between the first and second nozzle portions 14, 28 requires the application of excessive torque to force the ridge stop 32 by the inner threads 21. The engaged inner and outer threads 21, 31 and the enlarged diameter ridge stop 32 provide circumferential seals that isolate the second chamber 26. After engagement of the first and second nozzle portions 14, 28 the plastic tube 35 is heat shrunk over the outer surfaces thereof to provide an asceptic shield that prevents entry of bacteria or other contamination. The second tube container 25 then is similarly filled with the substance 27 through an open end 42 that subsequently is also hermetically sealed. It should be understood that the relative dimensions of the first and second nozzle portions 14, 28 are shown somewhat exaggerated to enhance an understanding of their operation.

Figure 3:
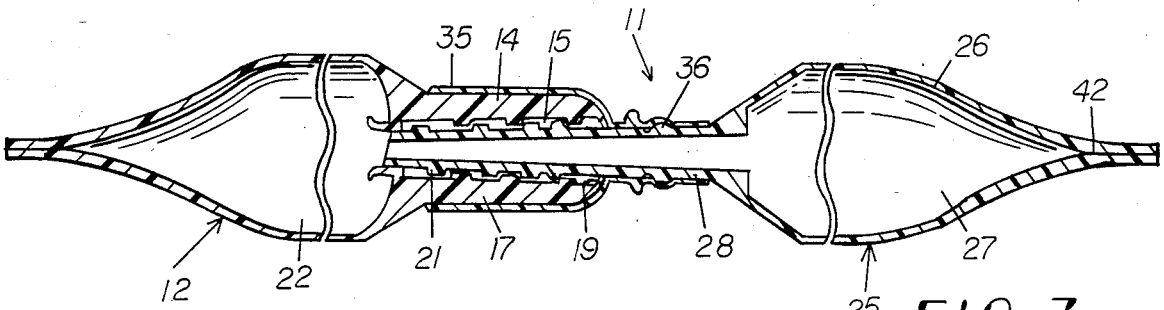
FIG. 3 is a schematic cross-sectional view similar to that illustrated in FIG. 2 but after activation.

When use of the substances 22 and 27 is desired, the second nozzle portion 28 is screwed farther into the first nozzle portion 14 forcing the second nozzle portion end 44 through the rupturable wall portion 16 into the position shown in FIG. 3. As noted above, that operation requires an application of sufficient torque to force the ridge stop 32 by the inner threads 21 of the first nozzle portion 14. The rupture of the wall portion 16 establishes communication between the first compartment 13 and the second compartment 26 via the interior 15 of the second nozzle portion 28. Squeezing of the second flexible tube container 25 then forces the second substance 27 through the second nozzle portion 28 into the partially evacuated first chamber 13. Additional mixing of the first and second substances 22, 27 is accomplished by alternately squeezing the first and second containers 12, 25 to force the combined substances 22, 27 back and forth through the second nozzle portion 28. After adequate mixing of the first and second substances 22, 27 and final deposition thereof in the first chamber 13, a transverse bending moment is applied to sever the second nozzle portion 28 at the weakened annulus portion 33. That action disconnects the second tube container 25 from the first nozzle portion 14. As the second tube container 25 is separated from the first tube container 12, the heat shrunk tube 35 adheres securely to the ridges 36 and is drawn off the first nozzle portion 14. Consequently, the tapered Luer slip connection 17 is exposed and can be accommodated by a mating female Luer connection (not shown). Squeezing of the first container 12 will then cause discharge of the mixed first and second substances 22, 27 out of the first nozzle portion 14 and into a receptacle (not shown) communicating with the engaged mating female Luer connection. When coupled to a cannula, the container 12 can be used for direct injection of the substances 22, 27 into a patient.

Thus, the invention provides for quick and efficient mixing and dispensing of stored plural substances in metered quantities. In addition, the storing, mixing and dispensing can be accomplished in an aseptic manner. As a further advantage the device is compatible with widely used Luer connections without any burdensome requirement for preliminary transfer to a dispenser equipped with a male Luer connection.

Obviously, many modifications and variations of the present invention are possible in light of the above teachings. It is to be understood, therefore, that the invention can be practiced otherwise than as specifically described.

What is claimed is:

1. A mixing and dispensing receptacle comprising:

a first unitary container defining a first nozzle portion comprising a smoothly tapered male Luer slip connection having an 0.060 inch taper per inch and adapted for engagement with a mating coupling member, a first sealed chamber retaining a first substance, and a rupturable wall portion separating said first chamber from the interior of said first nozzle portion;

a second unitary container defining a second nozzle portion and a second chamber retaining a second substance, said second nozzle portion being disposed at least partially within said interior of said first nozzle portion and circumferentially sealed thereto so as to sealingly isolate said second substance, and wherein said second nozzle portion is movable axially relative to said first nozzle portion so as to pierce said rupturable wall portion and provide communication between said first and second chambers; and an aseptic shield means covering said Luer slip connection and removable therefrom.

2. A receptacle according to claim 1 wherein both said first container means and said second container means comprise flexible wall portions.

3. A receptacle according to claim 2 wherein said second container means is adapted for disengagement from said first nozzle portion so as to permit engagement of said Luer slip connection with the mating coupling.

4. A receptacle according to claim 3 wherein said second nozzle portion comprises a weakened annulus adapted for rupture to permit separation of said second container means from said second nozzle portion.

5. A receptacle according to claim 4 wherein said shield means comprises a plastic tube heat shrunk over said first and second nozzle portions.

6. A receptacle according to claim 4 including stop means establishing an initial relative axial position between said first and second nozzle portions.

7. A receptacle according to claim 6 wherein said flexible wall portions comprise flexible tubes.

8. A receptacle according to claim 1 wherein said interior of said first nozzle portion defines inner threads and the outer surface of said second nozzle portion defines outer threads engaging said inner threads and movable therein to provide said relative axial movement.

9. A receptacle according to claim 8 wherein both said first container means and said second container means comprise flexible wall portions.

10. A receptacle according to claim 9 wherein said threads provide said circumferential seal.

11. A receptacle according to claim 10 wherein said second nozzle portion defines an annular ridge that engages said inner threads to form a stop that establishes an initial relative axial position between said first and second nozzle portions.

12. A receptacle according to claim 11 wherein said outer threads have a larger diameter than the diameter of the opening into said interior of said first nozzle portion.

13. A receptacle according to claim 12 wherein said flexible wall portions comprise flexible tubes.

14. A method of producing a mixing and dispensing receptacle comprising the following steps:

molding a first unitary container that defines a first nozzle portion comprising a smoothly tapered male Luer slip connection having an 0.060 inch taper per inch and adapted for engagement with a mating coupling member, a first chamber, and a rupturable wall portion separating said first chamber from the interior of said first nozzle portion; introducing a first substance into said first chamber; hermetically sealing said first chamber;

molding a second unitary container that defines a second nozzle portion and a second chamber; engaging said second nozzle portion within said first nozzle portion to provide a seal therebetween, said second nozzle portion being movable axially relative to said first nozzle portion so as to pierce said rupturable wall portion and provide communication between said first and second chambers;

introducing a second substance into said second chamber; and hermetically sealing said second chamber.

15. A method according to claim 14 including the step of covering said engaged first and second nozzle portions with a removable aseptic shield.

16. A method according to claim 15 including the steps of forming said dispenser with flexible wall portions.

17. A method according to claim 16 including the step of detachably forming said second portion so as to facilitate detachment thereof from said second container means.

18. A method according to claim 17 including the steps of forming threads on the interior of said first nozzle portion and on the outer surface of said second nozzle.

* * * * *